US005432980A

United States Patent [19]

Yao

[11] Patent Number: 5,432,980

[45] Date of Patent: Jul. 18, 1995

[54] CARDING MACHINE HIGH VOLTAGE SHORT FIBER REMOVAL MECHANISM

[75] Inventor: Shin-Chuan Yao, Taipei, Taiwan

[73] Assignee: China Textile T&R Institute, Taipei, Taiwan

[21] Appl. No.: 252,202

[22] Filed: Jun. 1, 1994

[51] Int. Cl.[6] ..... D01G 1/00; B03B 7/00

[52] U.S. Cl. ..... 19/98; 209/127.1; 209/129; 19/200

[58] Field of Search ..... 19/98, 106 R, 200; 209/12, 127.1, 128, 129, 131

[56] References Cited

U.S. PATENT DOCUMENTS 2,328,577 9/1943 Oglesby ..... 209/129 X
3,341,007 9/1967 Mayer, Jr. et al. ..... 209/127.1 X
3,341,008 9/1967 Mayer, Jr. et al. ..... 209/127.1 X
3,346,110 10/1967 LaFranca, Jr. et al. ..... 209/127.1 X
3,349,902 10/1967 LaFranca, Jr. et al. ..... 209/127.1 X
4,827,574 5/1989 Nakano et al. ..... 19/98 X
5,327,617 7/1994 Yao ..... 19/98

*Primary Examiner*—John J. Calvert
*Attorney, Agent, or Firm*—Morton J. Rosenberg; David I. Klein

[57] ABSTRACT

An improved carding machine for high voltage short fiber removal is provided, The mechanism utilizes a number of rollers arrayed in a semicircular configuration positioned near the pylon roller in order to shorten the distance between the last of the short fiber removal mechanisms and the pylon roller. The shortened distance achieves the practical effect of increasing fiber purity and straightness by providing for a more efficient method of short fiber removal.

1 Claim, 2 Drawing Sheets

CARDING MACHINE HIGH VOLTAGE SHORT FIBER REMOVAL MECHANISM

DESCRIPTION OF THE INVENTION

An improved carding machine for high voltage short fiber removal is provided. The mechanism, utilizes a number of small rollers arrayed in a semicircular configuration positioned near the pylon roller that are driven synchronously along the conveyor belt. Furthermore, the conveyor belt can be constructed out of a metallic or non-metallic material that conducts electricity.

BACKGROUND OF THE INVENTION

Short fiber elimination has a major influence on yarn quality and short fiber elimination is mainly handled by carding machines. The amount of short fiber removed is dependent on the quality sought and the raw material utilized (generally 15%–25%). However due to the design of a carding machine, the carded strands are often damages during straightening, lapping, and other preparation processes, including the removal of short fibers. From an economic point of view, this is a wasteful process. There are some new types of devices, such as that disclosed in the U.S. Pat. No. 08/049,499 shown in FIG. 1. Such systems utilize a high voltage field produced axially across long and short fibers, wherein the debris removal function differs in that a vacuum device is utilized to remove the short fibers and debris. The entire device is installed at the front of the carding machine, while the originally installed doffer and stranding equipment are removed. A special stripper roller 2 combs the fiber on the winding drum 1 into single fibers, while the single strands are blown into the high voltage field due to the vacuum equipment defined by vacuum channels 11, 12 and 13 located between opposing power rollers 3, 10 and coupled to a vacuum source 4. When the fibers are subjected to the effects of the high voltage field, the upper and lower metal conveyor belt plates (the conveyor belt has many holes) carry the fibers away towards the front (vacuum pylon roller 6). At the same time, since the short fibers and the debris are still under the influence of the voltage, this debris is propelled back and forth between the two conveyor belts. Meanwhile, the short fibers and the debris are suctioned away (approximately 1.5%–15% of the short fibers are vacuumed), since the power of the vacuum equipment installed in the metal conveyor belts is greater than the force of the electric field. The superior fiber, however, continues to be conveyed forward and matted by the pylon roller 6, and processed into strands by the stranding device 7. Since most the short fibers removed measure ½ inch or less, the aforementioned equipment not only effectively controls the short fiber content, but also maintains the fiber straightness that ensures yarn quality. Additionally, the aforesaid equipment replaces existent carding equipment and is a decisive development in terms of lowering production costs. However, since the distance between the final short fiber and debris removal section 13 and the pylon wheel 6 is excessively long in the aforementioned conventional structure, fibers tend to float and become deposited in the short fiber and debris removal section 13, resulting in uneven fiber matting and poor fiber quality. In order to overcome and improve these shortcomings, therefore, the primary objective of the invention herein is the provision of an improved kind of carding machine, high voltage short fiber removal device that utilizes a small group of rollers arrayed in a semicircular configuration to improve upon the conventional disadvantages of the conventional system and significantly increase the functional efficiency thereof.

DETAILED DESCRIPTION OF THE INVENTION

Figure 1:
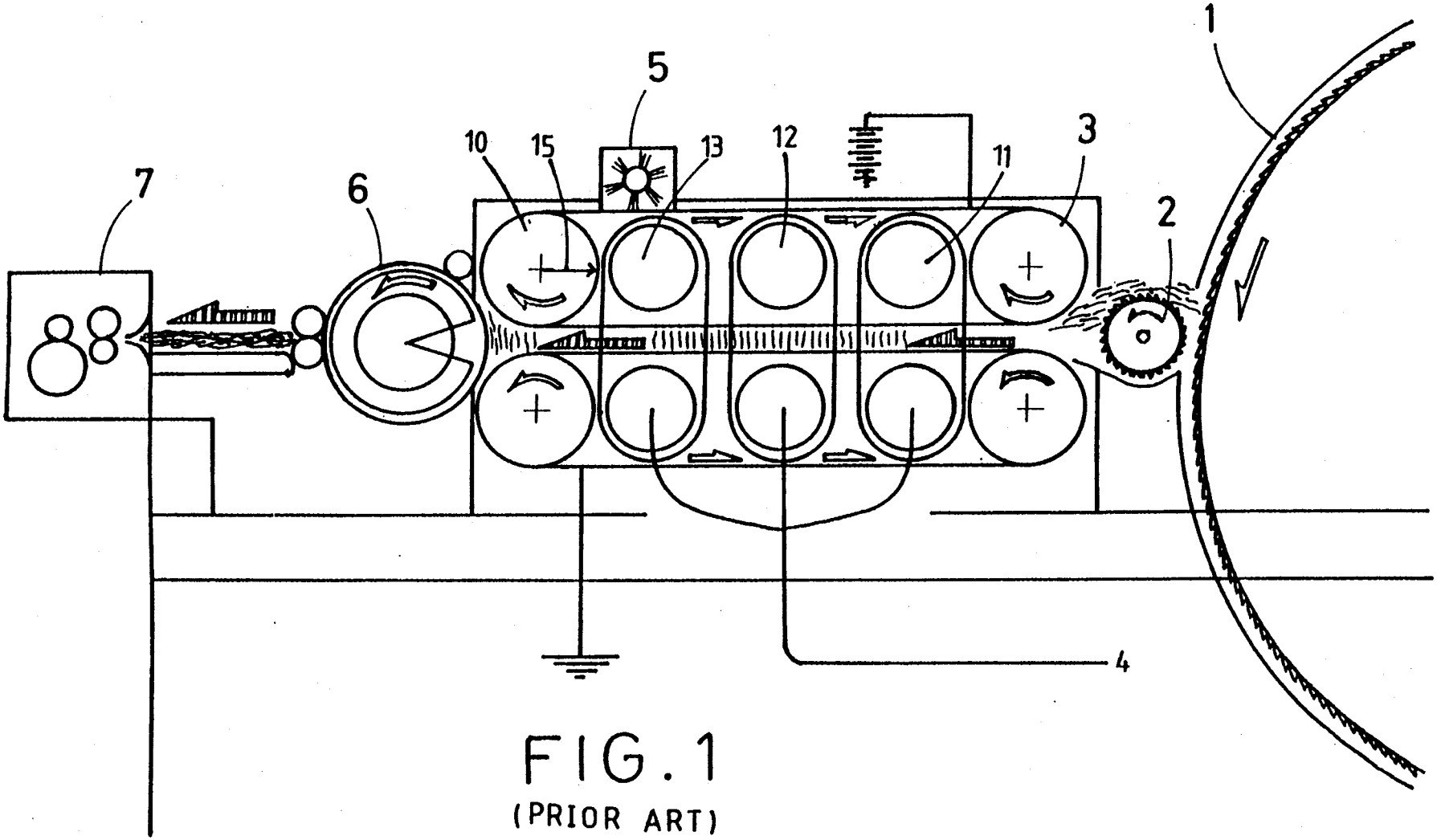
FIG. 1 (PRIOR ART)
FIG. 1 is an orthographic structural drawing of the conventional new-type device; and, FIG. 2 is an orthographic structural drawing of the improved device of the invention herein.
Figure 2:
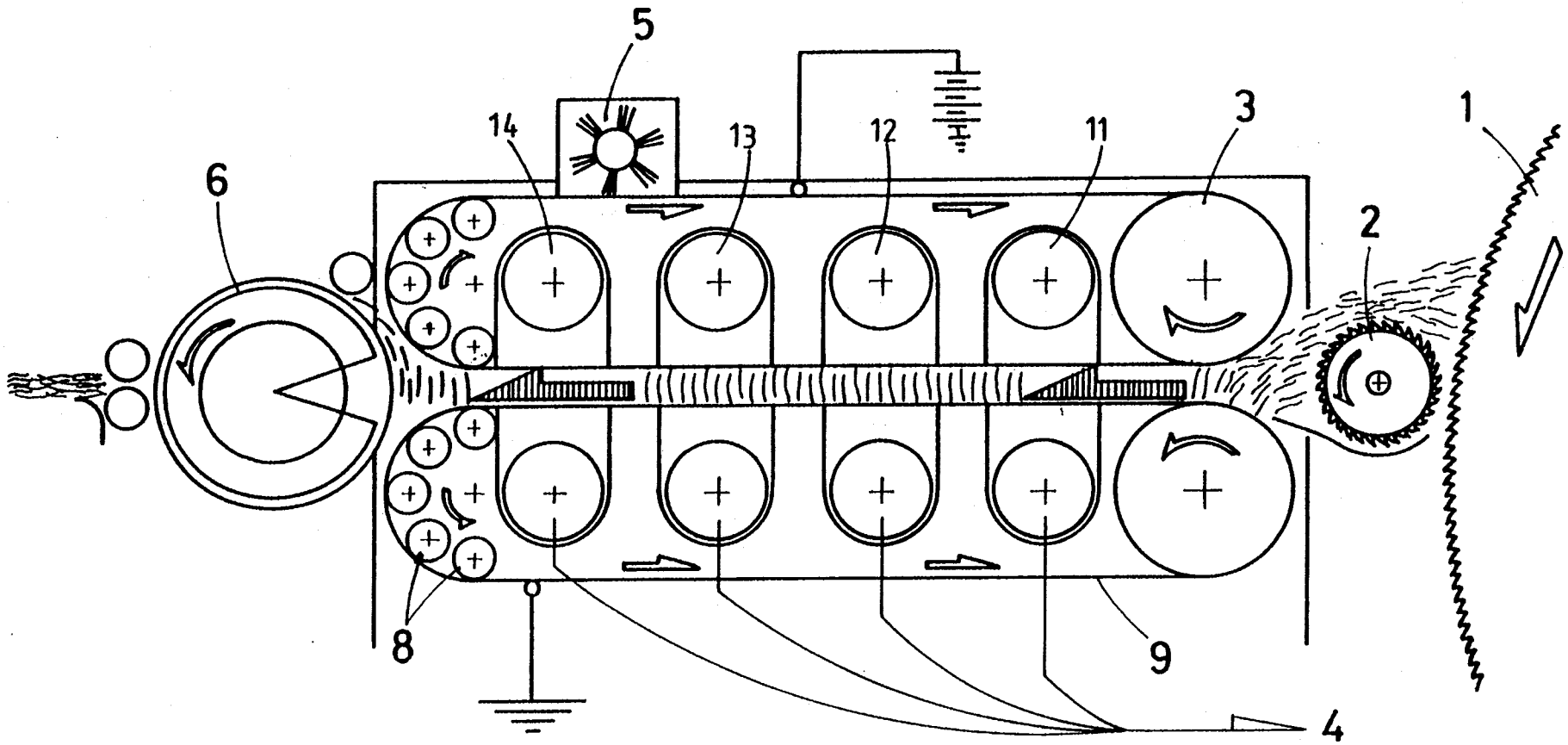

Referring to FIG. 2, the structural composition of the invention herein includes a conventional winding drum 1, a stripper roller 2, power rollers 3, vacuum channels 11, 12, 13 and 14 coupled to a vacuum source 4, a plurality of small rollers 8 disposed in semicircular arrays, a pair of conveyor belts 9, a cleaning brush 5, a vacuum pylon roller 6 which supplies a conventional output strand winding machine 7, wherein the basic operating methods and principles are similar to the foregoing description of the prior art and shall not be restated. In order to keep the short fiber vacuum mechanism as close as possible to the vacuum pylon roller 6, the endmost vacuum channel 14 is positioned immediately adjacent the semi-circular arrangement of small rollers 8 of each conveyor belt 9. In comparing this semi-circular arrangement with the prior art arrangement of FIG. 1, it can be seen that the semi-circular arrangement allows the endmost vacuum channel 14 to be located more closely toward the vacuum pylon roller 6, by a distance approximately equal to the radius 15 of the end roller 10, shown in FIG. 1. Therefore, the semi-circular arrangement of small rollers 8, essentially conserves the interior semi-circular space required by the prior art of end roller 10, which portion in the prior art prevented the placement of an endmost vacuum channel 13 as close to the vacuum pylon roller 6, as was desired. Furthermore, the extra space gained over the prior art arrangement by using the semi-circular arrangement of small rollers 8, allows for the addition of an additional, fourth, vacuum channel 14 therein, thereby increasing the rate of short fiber elimination.

Furthermore, the front roller 3 and the small rollers 8 in the conveyor mechanism of the invention operate synchronously, wherein conveyor belt 9 is modified such that there are holes through a softer surface made of an electrically conductive material to increase its service life.

Following the aforementioned structural improvements, the invention herein offers the following advantages:

1. Following the installation of the semicircular small roller group mechanism, the distance between the final short fiber and debris removal mechanism and the pylon roller mechanism is shortened, which enables the fibers conveyed by the pylon roller that are vacuumed to continue without the disadvantage of fiber deposit accumulation and, furthermore, ensures that the roller output is evenly matted and the fibers have a higher degree of straightness.

2. After the short fiber and debris mechanism is brought closer to the pylon roller, variances in vacuum force cannot develop into erratic or excessive currents and the air flow can be manually controlled, thereby yielding the effect of higher stability. Furthermore, the utilization of more area supports the expansion of the overall installation, wherein the short fiber and debris removal mechanism can be enlarged to four channels to enable a significant increase in short fiber and debris elimination rates.

3. After the conveyor belt driving mechanism is modified to a single-level forward and rear synchronous drive system, the driving force can be reduced to lessen the possibility of damage to the conveyor belt, while the conveyor belt is modified through the substitution of a softer material having conductive properties to avoid damage from the rotation of the drive rollers. Therefore, following the adoption of the aforesaid two improvements, the service life of the conveyor belt is prolonged substantially and the operating speed in revolutions is lowered to thereby raise economic cost-effectiveness.

What is claimed is:

1. A carding machine for removing short fibers from a plurality of fibers supplied by a winding drum and stripper roller comprising:

(a) a high voltage source having a pair of output terminals;

(b) a pair of horizontally disposed endless conveyors, said pair of conveyors being defined by a perforated upper and lower endless conveyor belt formed of a conducting material, each of said upper and lower conveyor belts having a top belt run, a bottom belt run, first and second semi-circular end belt runs, and an interior volume, said upper conveyor belt being vertically spaced and aligned with said lower conveyor belt, each of said upper and lower conveyor belts being respectively driven in a predetermined direction for displacing said bottom belt run of said upper conveyor belt and said top belt run of said lower conveyor belt in a common direction to thereby define a narrow passageway therebetween for carriage of the plurality of fibers, said passageway having an inlet end and an outlet end, said upper and lower conveyor belts each being coupled to a respective one of said pair of output terminals of said voltage source to form an electric field therebetween;

(c) a pair of power rollers, each of said pair of power rollers having a first predetermined diameter dimension and being positioned within a respective one of said interior volumes of said upper and lower conveyor belts for driving each of said conveyor belts, each of said power rollers being in contiguous contact with a respective one of said first semi-circular end belt runs adjacent said inlet end of said passageway;

(d) a plurality of first small rollers being positioned within said interior volume of said upper conveyor belt for driving said upper conveyor belt in synchronism with a respective one of said pair of power rollers, each of said plurality of first small rollers having a second predetermined diameter dimension, said second predetermined diameter dimension being smaller than said first predetermined diameter dimension, said plurality of first small rollers being semi-circularly arranged in contiguous contact with said second semi-circular end belt run of said upper conveyor belt positioned adjacent said outlet end of said passageway;

(e) a plurality of second small rollers being positioned within said interior volume of said lower conveyor belt for driving said lower conveyor belt in synchronism with a respective one of said pair of power rollers, each of said plurality of second small rollers having said second predetermined diameter dimension, said plurality of second small rollers being semi-circularly arranged in contiguous contact with said second semi-circular end belt run of said lower conveyor belt positioned adjacent said outlet end of said passageway;

(f) a plurality of horizontally spaced vacuum channels disposed within each of said interior volumes of said upper and lower conveyor belts to remove short fibers from the plurality of fibers, each of said interior volumes having one of said plurality of vacuum channels positioned in close proximity to a respective one of said semi-circularly arranged plurality of said first and second small rollers;

(g) a vacuum pylon roller positioned adjacent said outlet end of said passageway for matting the plurality of fibers.

* * * * *